US008689887B2

(12) United States Patent
Ross

(10) Patent No.: US 8,689,887 B2
(45) **Date of Patent: *Apr. 8, 2014**

(54) METHODS OF OPERATING A RADIAL FLOW VALVE

(75) Inventor: Richard J. Ross, Houston, TX (US)

(73) Assignee: Superior Energy Services, LLC, Harvey, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/592,486

(22) Filed: Aug. 23, 2012

(65) Prior Publication Data

US 2012/0312558 A1 Dec. 13, 2012

Related U.S. Application Data

(63) Continuation of application No. 12/048,517, filed on Mar. 14, 2008, now Pat. No. 8,251,150.

(51) Int. Cl.
*E21B 34/10* (2006.01)
*E21B 34/14* (2006.01)

(52) U.S. Cl.
USPC ..... 166/374; 166/319; 166/332.1; 166/332.4

(58) Field of Classification Search
USPC ..... 166/374, 319, 332.1, 332.4, 332.6, 166/334.1, 334.4; 137/624.27
See application file for complete search history.

(56) References Cited

U.S. PATENT DOCUMENTS

| | | | | |
|---|---|---|---|---|
| 4,114,694 | A * | 9/1978 | Dinning | 166/318 |
| 4,691,779 | A * | 9/1987 | McMahan et al. | 166/321 |
| 7,168,493 | B2 * | 1/2007 | Eddison | 166/334.4 |
| 7,575,051 | B2 * | 8/2009 | Stoesz et al. | 166/177.6 |

* cited by examiner

*Primary Examiner* — Shane Bomar
*Assistant Examiner* — Robert E Fuller
(74) *Attorney, Agent, or Firm* — Jones Walker LLP

(57) ABSTRACT

A radial flow valve is disclosed which includes a plurality of flow openings, a first piston and a second piston, the first and second pistons being independently actuable relative to one another, and a sleeve operatively coupled to the second piston, the sleeve adapted to be positioned so as to cover the plurality of flow openings. A method is also disclosed which includes positioning a radial flow valve in a subterranean well bore having an upper zone pressure and a lower zone pressure, increasing a pressure within the valve to a value above the upper zone pressure to release a first piston within the valve and, after releasing the first piston, reducing the pressure within the valve to a value that is less than the lower zone pressure to thereby cause a second piston within the valve to move and thereby permit fluid flow through the valve.

15 Claims, 9 Drawing Sheets

FIG. 1C
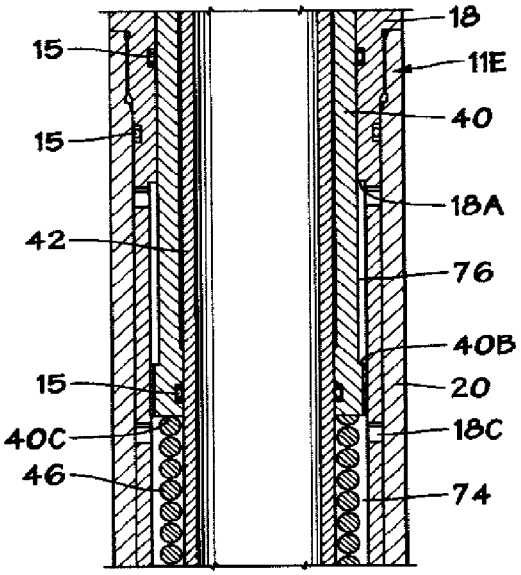
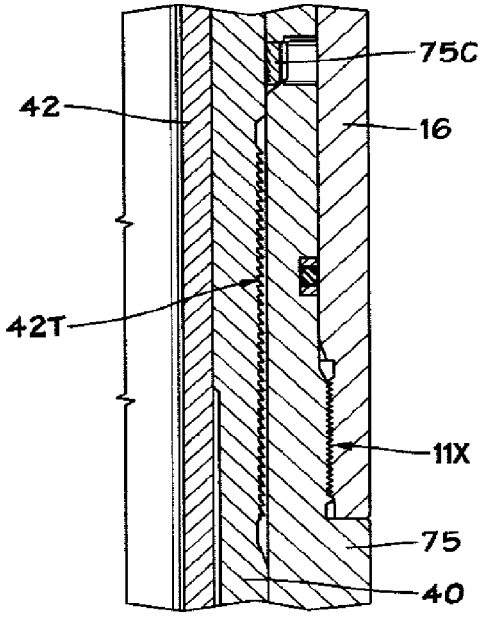
FIG. 1E
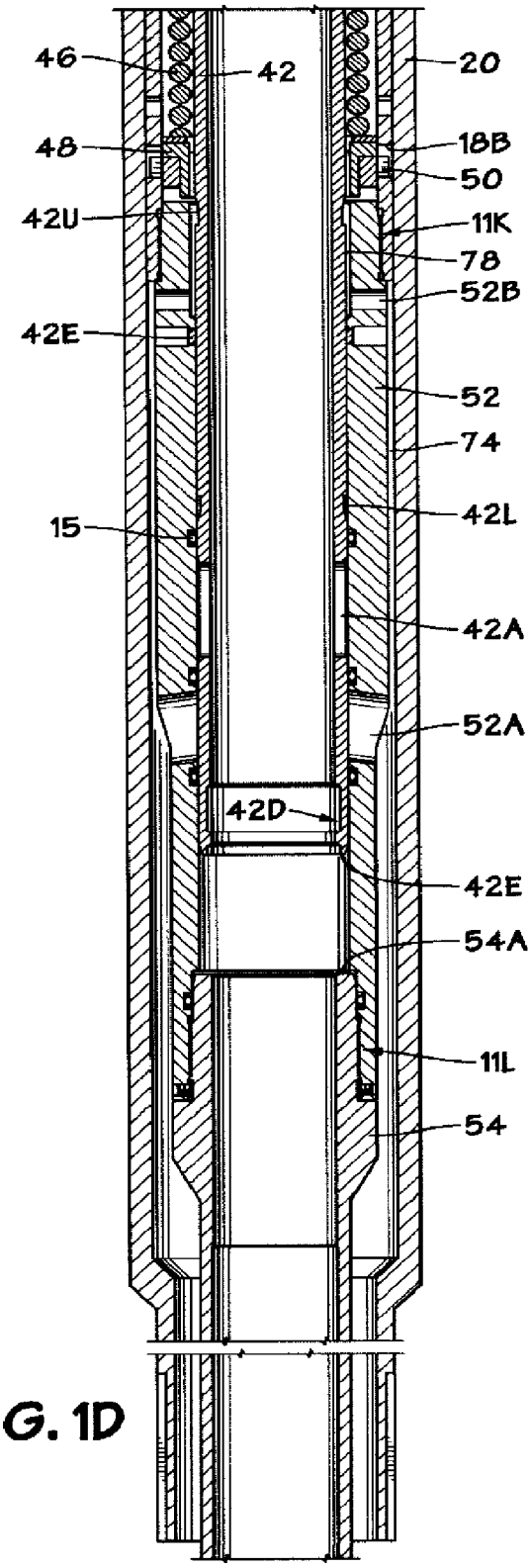
FIG. 1D

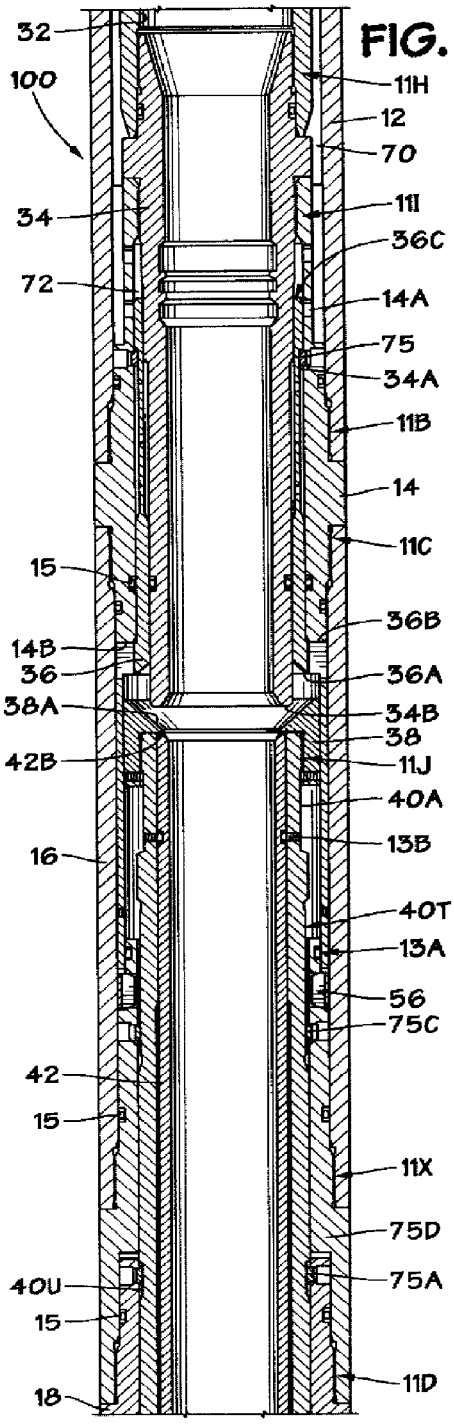
FIG. 3A
FIG. 3B
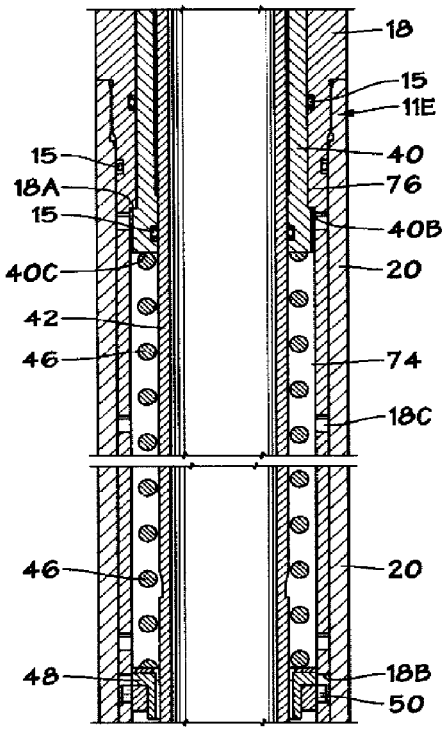

FIG. 3C
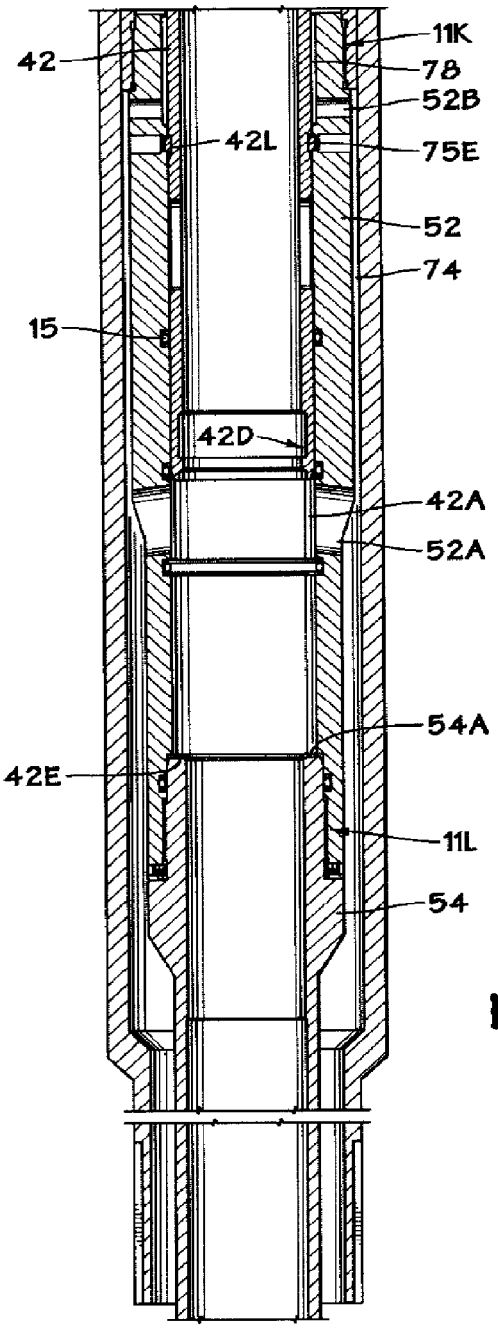
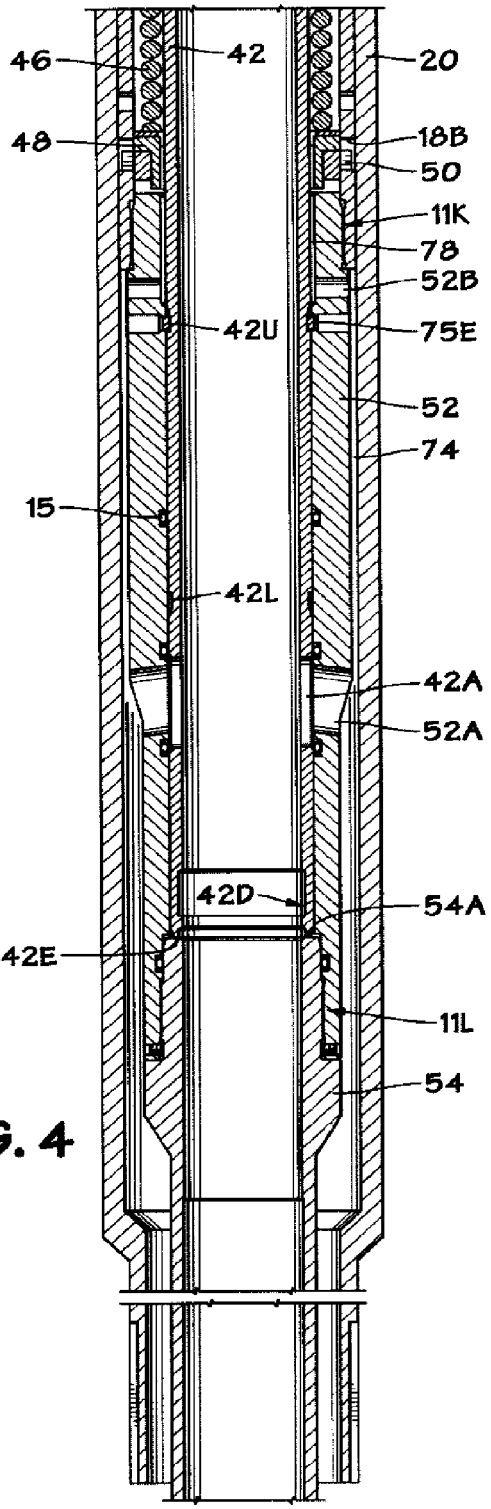
FIG. 4

METHODS OF OPERATING A RADIAL FLOW VALVE

This is a continuation of U.S. application Ser. No. 12/048,517, filed on Mar. 14, 2008, the entirety of which is hereby incorporated by reference.

BACKGROUND OF THE INVENTION

1. Field of the Invention

The present invention is generally directed to downhole tools employed in oil and gas wells, and, more particularly, to a radial flow valve.

2. Description of the Related Art

Early prior art isolation systems involved intricate positioning of tools which were installed downhole after the gravel pack. These systems are exemplified by a commercial system which at one time was available from Baker. This system utilized an anchor assembly which was run into the wellbore after the gravel pack. The anchor assembly was released by a shearing action and subsequently latched into position.

Certain disadvantages have been identified with the systems of the prior art. For example, prior conventional isolation systems have had to be installed after the gravel pack, thus requiring greater time and extra trips to install the isolation assemblies. Also, prior systems have involved the use of fluid loss control pills after gravel pack installation, and have required the use of through-tubing perforation or mechanical opening of a wireline sliding sleeve to access alternate or primary producing zones. In addition, the installation of prior systems within the wellbore require more time-consuming methods with less flexibility and reliability than a system which is installed at the surface.

Later prior art isolation systems provided an isolation sleeve which was installed inside the production screen at the surface and thereafter controlled in the wellbore by means of an inner service string. For example, U.S. Pat. No. 5,865,251, incorporated herein by reference, illustrates an isolation assembly which comprises a production screen, an isolation pipe mounted to the interior of the production screen, the isolation pipe being sealed with the production screen at proximal and distal ends, and a sleeve movably coupled with the isolation pipe. The isolation pipe defines at least one port and the sleeve defines at least one aperture, so that the sleeve has an open position with the aperture of the sleeve in fluid communication with the port in the isolation pipe. When the sleeve is in the open position, it permits fluid passage between the exterior of the screen and the interior of the isolation pipe. The sleeve also has a closed position with the aperture of the sleeve not in fluid communication with the port of the isolation pipe. When the sleeve is in the closed position, it prevents fluid passage between the exterior of the screen and the interior of the isolation pipe. The isolation system also has a complementary service string and shifting tool useful in combination with the isolation string. The service string has a washpipe that extends from the string to a position below the sleeve of the isolation string, wherein the washpipe has a shifting tool at the end. When the completion operations are finalized, the washpipe is pulled up through the sleeve. As the service string is removed from the wellbore, the shifting tool at the end of the washpipe automatically moves the sleeve to the closed position. This isolates the production zone during the time that the service string is tripped out of the well and the production seal assembly is run into the well.

Prior art systems that do not isolate the formation between tool trips suffer significant fluid losses. Those prior art systems that close an isolation valve with a mechanical shifting tool at the end of a washpipe prevent fluid loss. However, the extension of the washpipe through the isolation valve presents a potential failure point. For example, the washpipe may become lodged in the isolation string below the isolation valve due to debris or settled sand particles. Also, the shifting tool may improperly mate with the isolation valve and become lodged therein.

The present subject matter is directed to an apparatus for solving, or at least reducing the effects of, some or all of the aforementioned problems.

SUMMARY OF THE INVENTION

The following presents a simplified summary of the subject matter disclosed herein in order to provide a basic understanding of some aspects of the disclosed devices and methods. This summary is not an exhaustive overview of the details disclosed herein. It is not intended to identify key or critical elements of the invention or to delineate the scope of the invention. Its sole purpose is to present some concepts in a simplified form as a prelude to the more detailed description that is discussed later.

In one illustrative embodiment, a radial flow valve is disclosed which includes a plurality of flow openings, a first piston and a second piston that are independently actuable relative to one another. The valve also includes a sleeve that is operatively coupled to the second piston, wherein the sleeve is adapted to be positioned so as to cover the flow openings (valve closed) or positioned where it does not cover the flow openings (valve open). The first piston is movable in response to a pressure within the valve being greater than the upper zone pressure of a subterranean well while the second piston is movable in response to a pressure within the valve being less than the lower zone pressure of the well.

In one illustrative embodiment, a method is disclosed which includes positioning a radial flow valve in a subterranean well bore having an upper zone pressure and a lower zone pressure, increasing a pressure within the valve to a value above the upper zone pressure to release a first piston within the valve and, after releasing the first piston, reducing the pressure within the valve to a value that is less than the lower zone pressure to thereby cause a second piston within the valve to move and thereby permit fluid flow through the valve.

BRIEF DESCRIPTION OF THE DRAWINGS

The invention may be understood by reference to the following description taken in conjunction with the accompanying drawings, in which like reference numerals identify like elements, and in which:

FIGS. 1A-1E are directed to one illustrative embodiment of a downhole tool comprising a radial flow valve as it is initially being run into a well;

FIGS. 3A-3C depict the tool shown in FIGS. 1A-1E wherein the tubing pressure has been decreased to a value below lower zone pressure;

FIG. 4 depicts the tool shown in FIGS. 1A-1E wherein the valve may be mechanically opened;

Figure 1A:
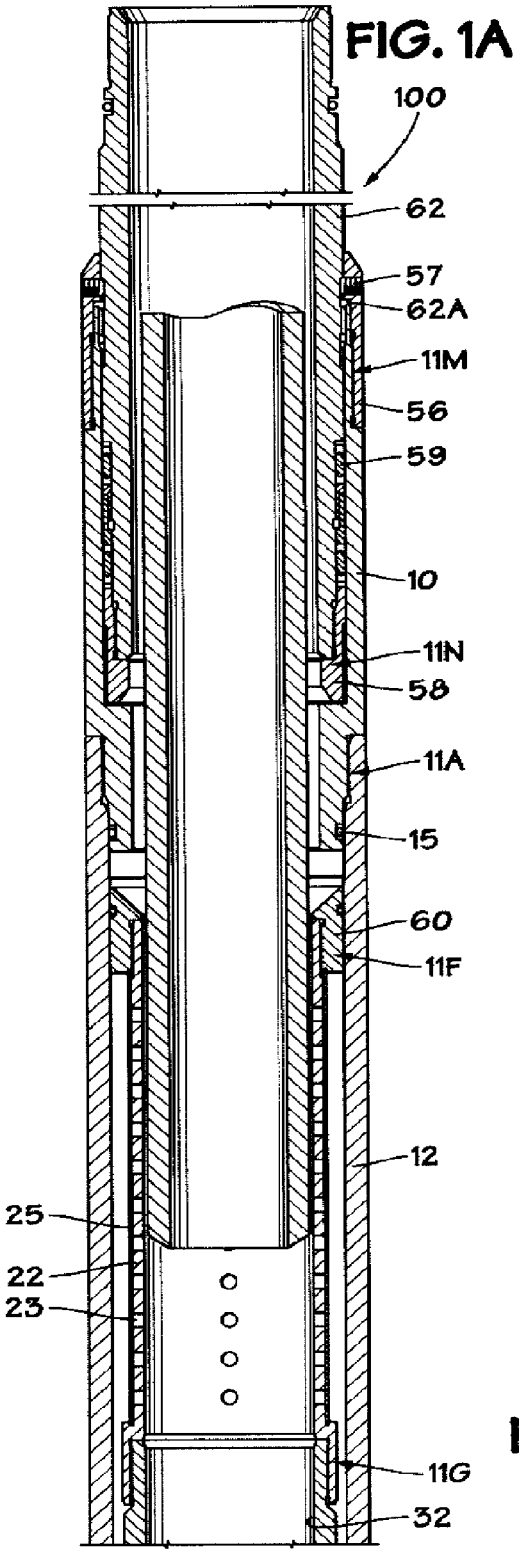
Figure 1B:
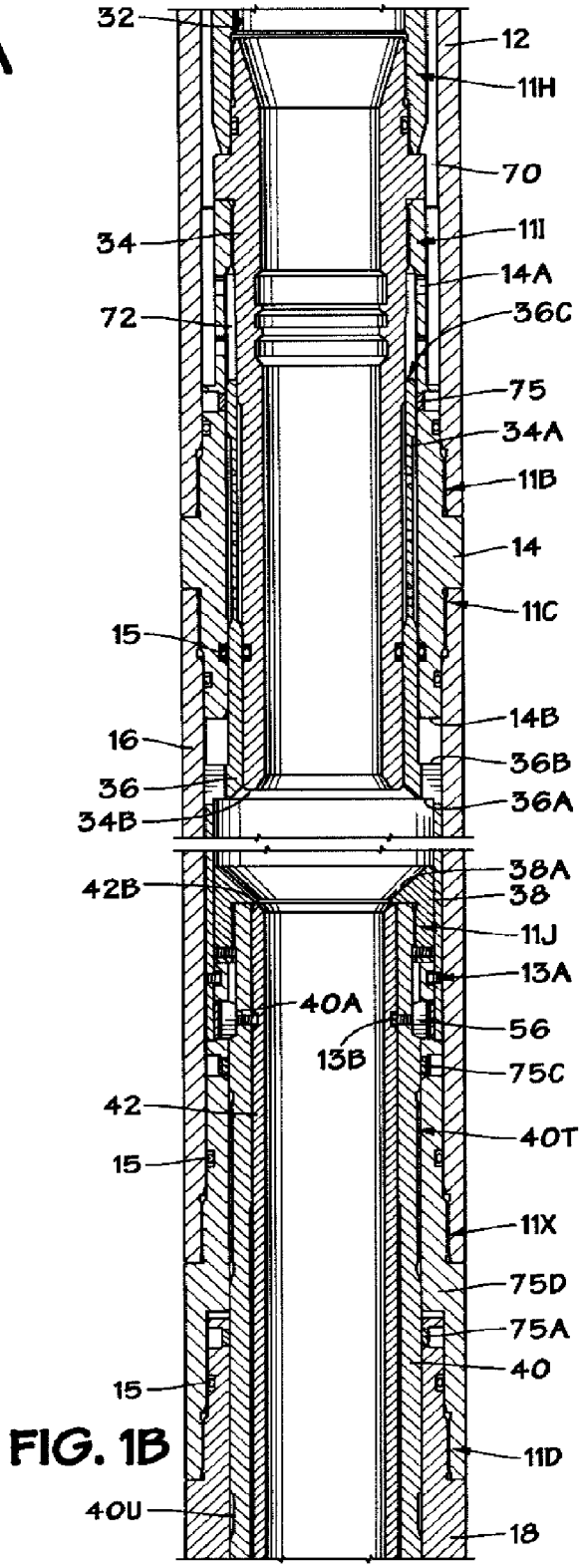

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

One illustrative embodiment of a radial flow valve 100 disclosed herein will now be described with reference to FIGS. 1A-1E. In general, the tool comprises a top sub 10, a seal bore housing 12, an upper threaded sub 14, an upper piston housing 16, a ratchet ring sub 75D, a lower threaded sub 18 and a lower piston housing 20. The tool 100 further comprises a screen support 22, a screen holder ring 60, a seal bore 32, an upper flow tube 34, a first or release piston 36, a threaded cap ring 38, a second or valve piston 40, a closing sleeve 42, a spring 46, a spring stop ring 48, a key 50, a ported sub 52 and a lower flow tube 54. The tool 100 further comprises a threaded outer retainer ring 56, a retainer screw 57, a seal assembly 59, a threaded seal retainer ring 58, a quick connect mandrel 62, a first snap ring 75, a second snap ring 75A, a third snap ring 75E and a ratchet ring 75C. A toothed profile 40T and a profile 40U are formed on the outer surface of the piston 40. The toothed profile 40T is adapted to engage the ratchet ring 75C. The profile 40U is adapted to engage the second snap ring 75A. The closing sleeve 42 also has upper and lower profiles 42U, 42L, respectively, that are adapted to engage the third snap ring 75E. The screen support 22 has a plurality of openings 23 and a screen 25.

The seal bore housing 12 is threadingly coupled to the upper sub 10 and the upper threaded sub 14 via threaded connections 11A, 11B, respectively. The upper piston housing 16 is threadingly coupled to the upper threaded sub 14 and the ratchet ring sub 75D via threaded connections 11C, 11X, respectively. The ratchet ring sub 75D is also threadingly coupled to the lower threaded sub 18 via the thread connection 11D. The lower piston housing 20 is threadingly coupled to the lower threaded sub 18 via the threaded connection 11E. The screen support 22 is threadingly coupled to the screen holder ring 60 and the seal bore 32 via the threaded connections 11F, 11G, respectively. The seal bore 32 is threadingly connected to the upper flow tube 34 via threaded connection 11H. The upper flow tube 34 is threadingly coupled to the upper threaded sub 14 via threaded connection 11I. The first piston 36 is releasably coupled to the upper piston housing 16 via shear pin connection 13A. The cap ring 38 is threadingly coupled to the closing sleeve 42 via threaded connection 11J. The second piston 40 is releasably coupled to the lower threaded sub 18 by a plurality of actuatable dogs 56 that engage a profile 40A formed on the upper end of the second piston 40. Of course, other mechanical means could be employed for the connection, e.g., collet fingers, a snap ring, etc. The ported sub 52 is threadingly coupled to the lower threaded sub 18 and the lower flow tube 54 via threaded connections 11K, 11L, respectively. The upper sub 10 is threadingly coupled to the outer retainer ring 56 via threaded connection 11M. The set screw 57 engages a recess 62A formed in the quick connect mandrel 62. The seal retainer ring 58 is threadingly coupled to the lower end of the quick connect mandrel 62 via the threaded connection 11N. The seal retainer ring 58 acts to retain the seal assembly 59 in the annular space between the top sub 10 and the quick connect mandrel 62. A plurality of seals 15, e.g., O-rings, are provided between various components of the tool 100 as depicted in the drawings.

A shoulder 40B on the second piston 40 is adapted to engage a shoulder 18A on the lower threaded sub 18 to thereby limit the upward movement of the second piston 40. The closing sleeve 42 is releasably coupled to the second piston 40 via shear pin connection 13B. The spring stop ring 48 engages a key 50 that engages an opening 18B in the lower threaded sub 18.

The upper threaded sub 14 comprises a plurality of openings 14A that communicate with a region 70 and a region 72. The region 70 is defined in part by the annular space between the outer diameter of the upper threaded sub 14 and the inner diameter of the seal bore housing 12. The region 72 is defined by the outside diameter of the upper flow tube 34, the inside diameter of the upper threaded sub 14 and the upper portion 36C of the first piston 36. The region 70 is always exposed to upper zone pressure. The openings 14A insure that the region 72 will always be at the upper zone pressure as well. This upper zone pressure acts on the upper portion 36C of the piston 36. The lower threaded sub 18 comprises a plurality of openings 18C that communicate with regions 74 and 76. The region 74 is always exposed to lower zone pressure. The region 76 is defined by the outside diameter of the piston 40 and by the inside diameter of the lower threaded sub 18. The openings 18C insure that the region 76 will always be at the lower zone pressure. The closing sleeve 42 comprises a plurality of flow openings 42A. The ported sub 52 comprises a plurality of flow openings 52A. When aligned, the flow openings 42A permit flow of fluid through the flow openings 52A.

FIGS. 1A-1E depicted the tool 100 as it is initially run into the well. In this configuration, the first piston 36 is in its lowermost position, and it is secured in that position via the shear pin connection 13A. In this initial position, the second piston 40 is in its lowermost position, and it is secured in that position via the shear pin connection 13A, the threaded connection 11J and the engagement between the profile 40A and the actuatable dogs 56. The openings 52A are blocked by the closing sleeve 42 in this initial, run-in, position. In this initial run-in position, the spring 46 is compressed, thereby creating a biasing force that will tend to force the second piston 40 upward.

Figure 2A:
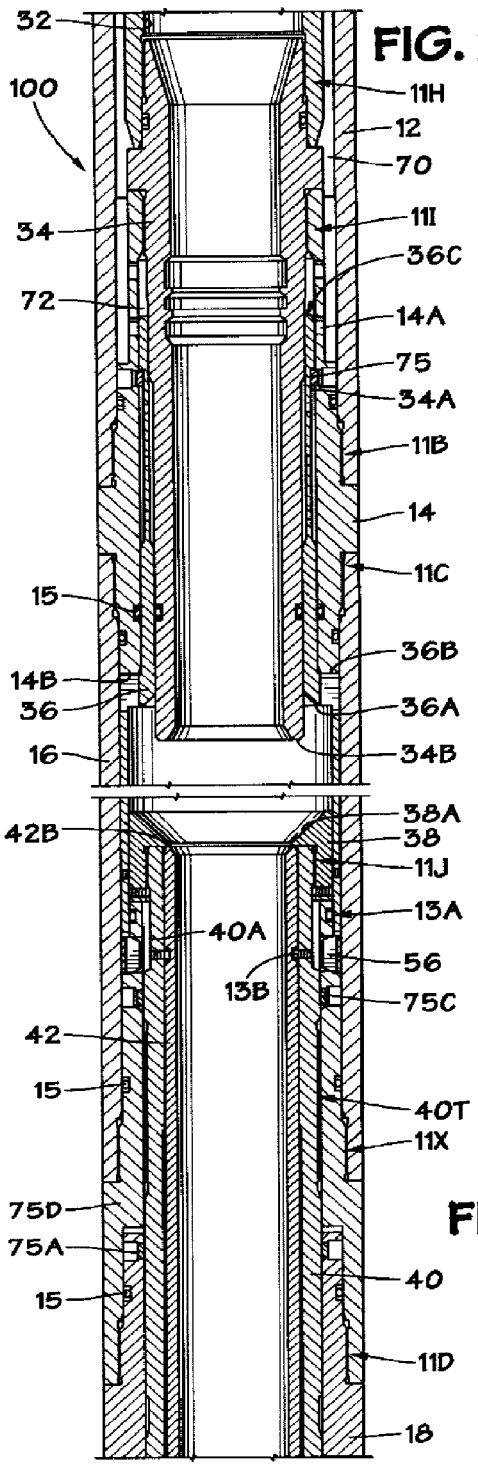
FIGS. 2A-2B depict the tool shown in FIGS. 1A-1E wherein the tubing pressure has been increased to a value above upper zone pressure.
Figure 2B:
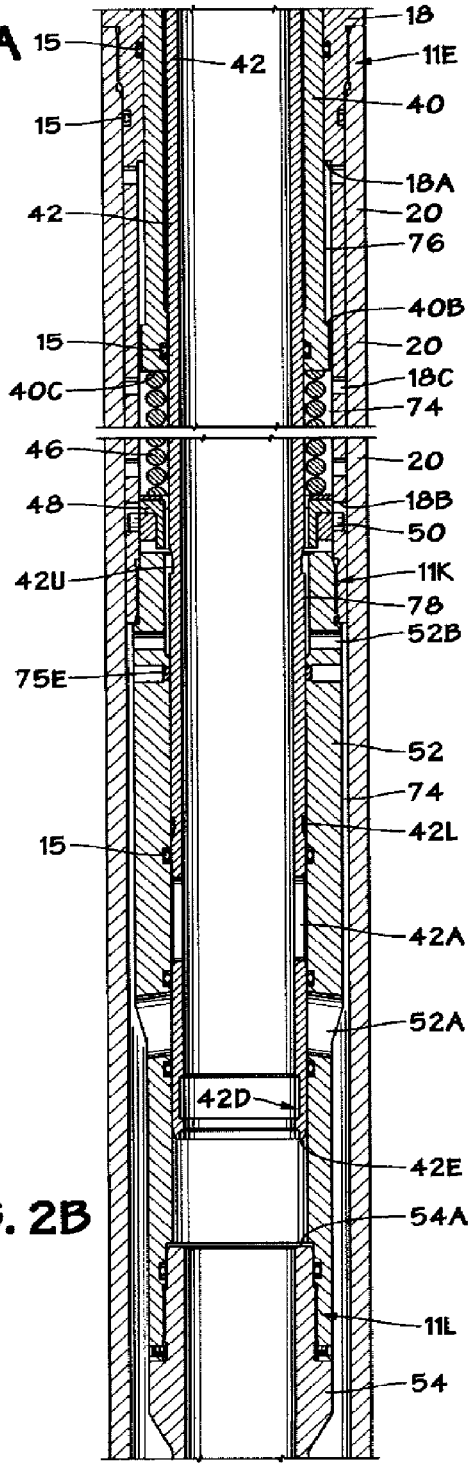
Figure 5A:
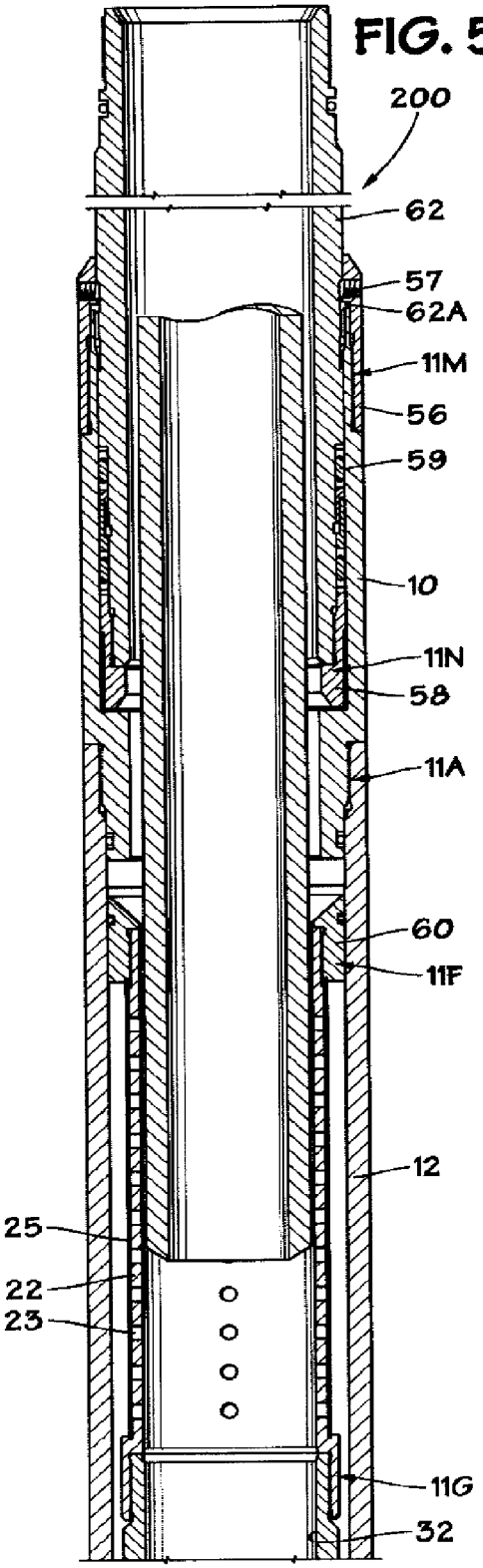
FIGS. 5A-5D are directed to another illustrative embodiment of a downhole tool described herein as it is initially being run into a well.
Figure 5B:
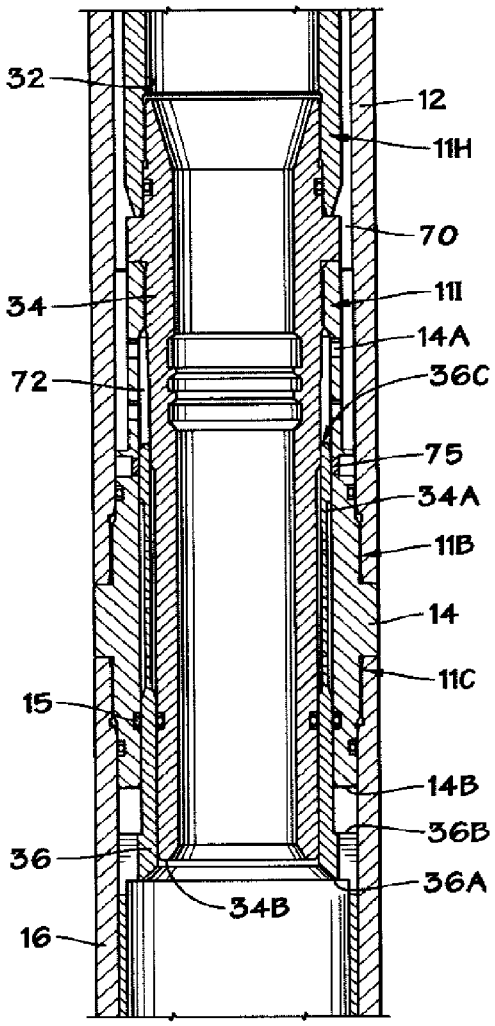
Figure 5C:
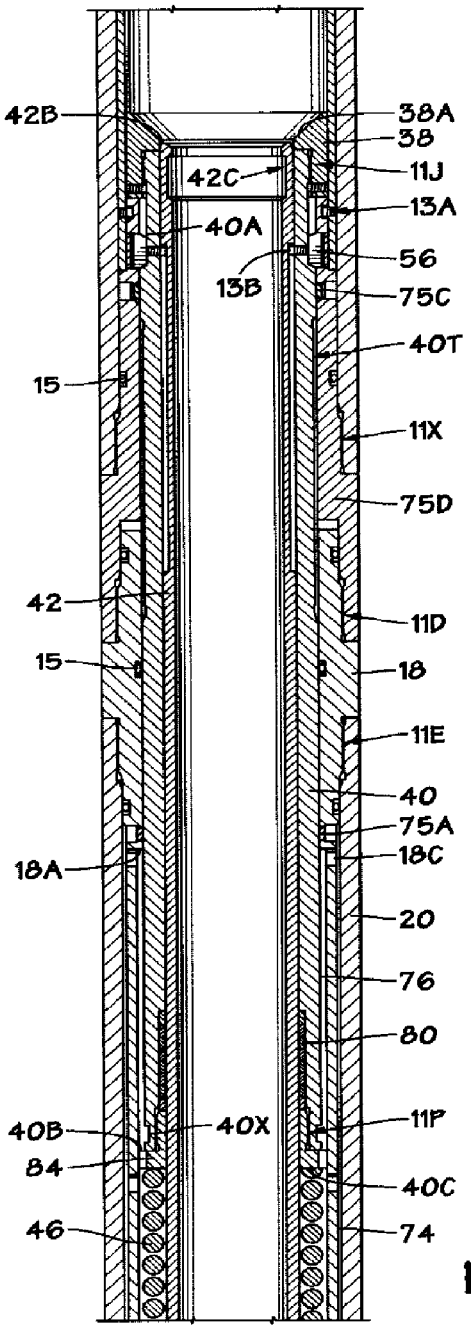
Figure 5D:
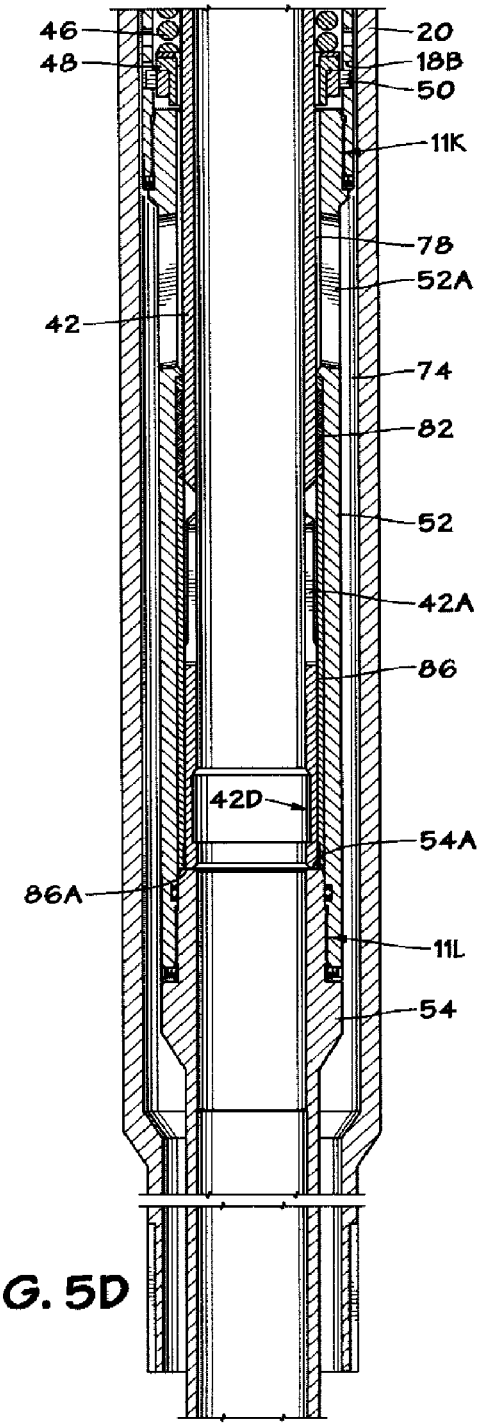

FIGS. 2A-2B depict portions of the tool 100 wherein the first piston 36 has been released. Internal tubing pressure acts on the surface 36A of the first piston 36. The internal pressure within the tubing is increased so as to drive the first piston 36 upward and fail the shear pin connection 13A. By virtue of failing the shear pin connection 13A, the first piston 36 moves to its uppermost position wherein the shoulder 36B engages the end surface 14B on the upper threaded sub 14. The required pressure within the tubing to cause the first piston 36 to move from its lowermost to uppermost position may vary depending upon the particular application. The upper zone pressure (within zone 72) acts on the surface 36C to force the first piston 36 downward. The pressure within the tubing must be sufficiently large so as to overcome the upper zone pressure acting on the surface 36C of the first piston 36, considering the relative surface area of the surfaces 36A, 36B, and provide sufficient force to fail the shear pin connection 13A. In one illustrative embodiment, the pressure within the tubing may be approximately 2-7 Kpsi greater than the upper zone pressure. As the piston 36 moves to its uppermost position, the snap ring 75 extends and registers with a recess 34A formed in the upper flow tube 34. Once the first piston 36 reaches its uppermost position, the spring actuated dogs 56 are free to move radially outward and become disengaged from the profile 40A formed in the second piston 40. Also note that, in the position depicted in FIGS. 2A-2B, the flow openings 52A in the ported sub 52 are still blocked by the closing sleeve 42.

FIGS. 3A-3C depict portions of the tool 100 wherein the closing sleeve 42 is moved to a position such that the closing sleeve 42 no longer blocks the flow openings 52A. The pressure within the tubing acts on the surface 38A of the cap ring 38 and the surface 42B of the closing sleeve 42. The ported sub 52 comprises a plurality of openings 52B that permit the lower zone pressure to exist in region 78. Thus, lower zone pressure acts on the lower surface 40C of the second piston 40. Lower zone pressure also exists within the region 76 and acts on the area defined by the shoulder 40B. However, given the relatively large surface area defined by the lower surface 40C, the net effect will be to move the second piston 40 upward. To move the piston 40, and thereby open the valve, the pressure within the tubing is reduced to a value that is approximately the same or may be slightly less than the lower zone pressure, e.g., 200 psi less than the lower zone pressure. Typically, with the pressure within the valve being reduced to approximately lower zone pressure, the spring 46 may provide the force to open the valve. The upward travel of the second piston 40 is limited via the engagement of the surface 42B with the end 34B on the upper flow tube 34. Movement of the second piston 40 to its uppermost position is encouraged by the stored spring force in the spring 46. Movement of the second piston 40 to its uppermost position also causes the closing sleeve 42, that is connected to the second piston 40 via the shear pin connection 13B, to travel to its uppermost position. As the second piston 40 moves upward, the toothed profile 40T engages the ratchet ring 75C, the second snap ring 75A engages the profile 40U, and the third snap ring 75E engages the profile 42L. With the closing sleeve 42 in its uppermost position, the closing sleeve 42 no longer blocks the openings 52A and the flow of fluid through the flow openings 52A in the valve is now permitted. The tool 100 remains in the position shown in FIGS. 3A-3C as long as the lower zone pressure (which acts on the surface 40C on the second piston 40) is greater than the pressure within the tubing (which acts on the surfaces 38A and 42B).

If for some reason the second piston 40 becomes stuck, locked or otherwise becomes inoperable or non-responsive to changes in tubing pressure, a wireline tool (not shown) can be run down the well to the tool 100 and engage the profile 42D formed in the closing sleeve 42. Mechanical force may thereafter be applied so as to shear the shear pin connection 13B between the closing sleeve 42 and the second piston 40. The closing sleeve 42 may thereafter be driven to a position wherein its end surface 42E abuts the end surface 54A of the lower flow tube 54, as shown in FIG. 4. In that position, the openings 42A in the closing sleeve 42 are aligned with the openings 52A and flow is permitted through the valve.

FIGS. 5A-5D depict another embodiment of a tool 200 wherein the valve is closable. The tool 200 is similar in many respects to the tool 100 discussed previously. Thus, commonly numbered parts in the respective drawings are intended to refer to the same structure. As to differences between the illustrative embodiment of the tool 100 as compared to the illustrative embodiment of the tool 200, the tool 200 comprises an upper seal stack 80, a lower seal stack 82, an upper threaded seal retainer ring 84 and a lower seal retainer ring 86. The upper threaded seal retainer ring 84 is threadingly coupled to the lower end of the piston 40 at the threaded connection 11P. The upper threaded seal retainer ring 84 acts to retain the upper seal stack 80 in the annular space between the second piston 40 and the closing sleeve 42. The lower seal retainer ring 86 is positioned in the annular space between the ported sub 52 and the closing sleeve 42. The end surface 54A of the lower flow tube 54 abuts the end surface 86A of the lower seal retainer ring 86 and thereby maintains the lower seal stack 82 in the annular space between the ported sub 52 and the closing sleeve 42. The upper and lower seal stacks 80, 82 may be comprised of one or more plastic or non-elastomeric seals which have greater durability as compared to elastomeric O-rings. In the tool 200, the openings 52A in the ported sub 52 are slotted openings, wherein the slots are of a size such that the upper seal stack 82 cannot pass through the slotted openings 52A.

Figure 6A:
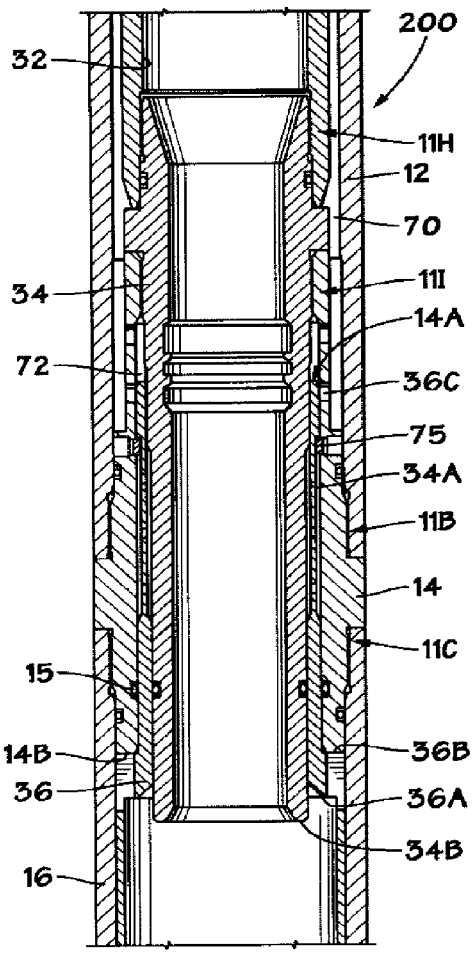
FIGS. 6A-6B depict the tool shown in FIGS. 5A-5D wherein the tubing pressure has been increased to a value above upper zone pressure.
Figure 6B:
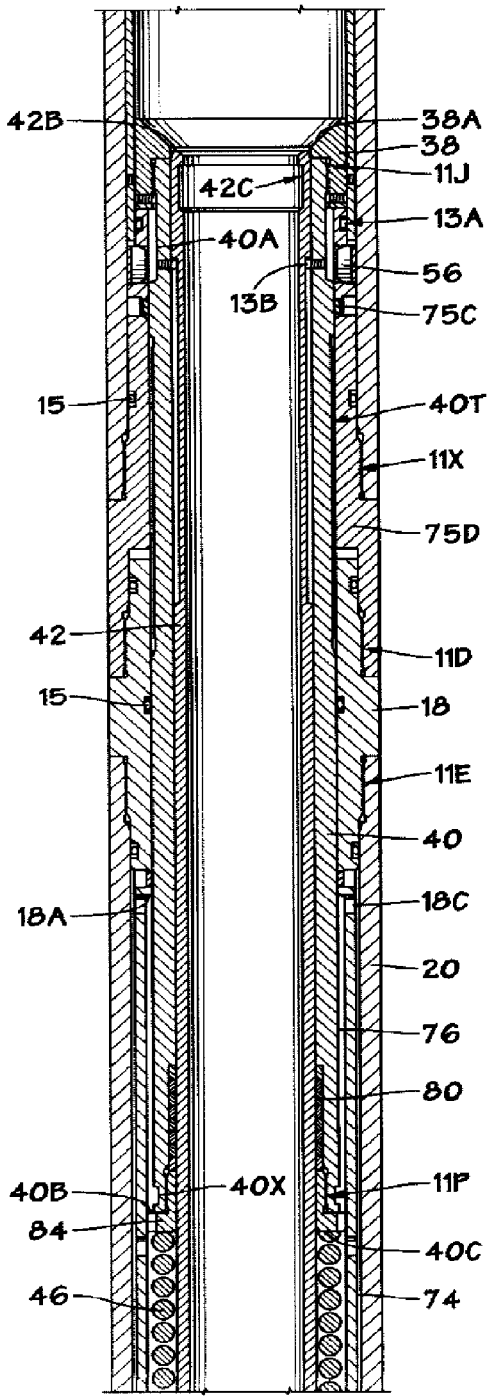
Figure 7A:
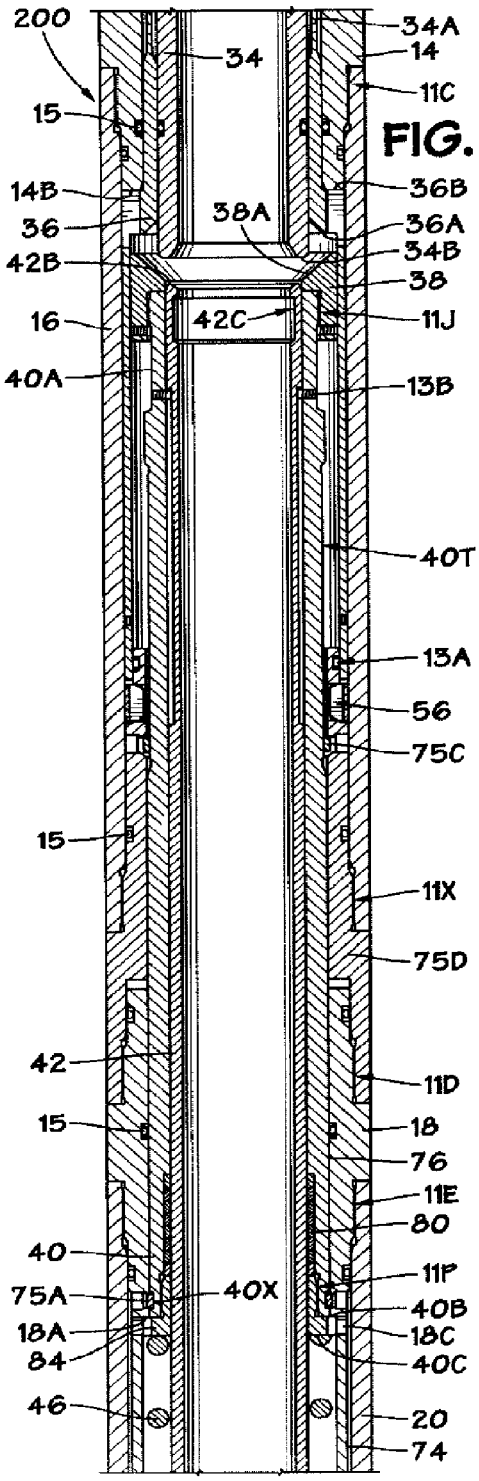
FIGS. 7A-7B depict the tool shown in FIGS. 5A-5D wherein the tubing pressure has been decreased to a value below lower zone pressure.
Figure 7B:
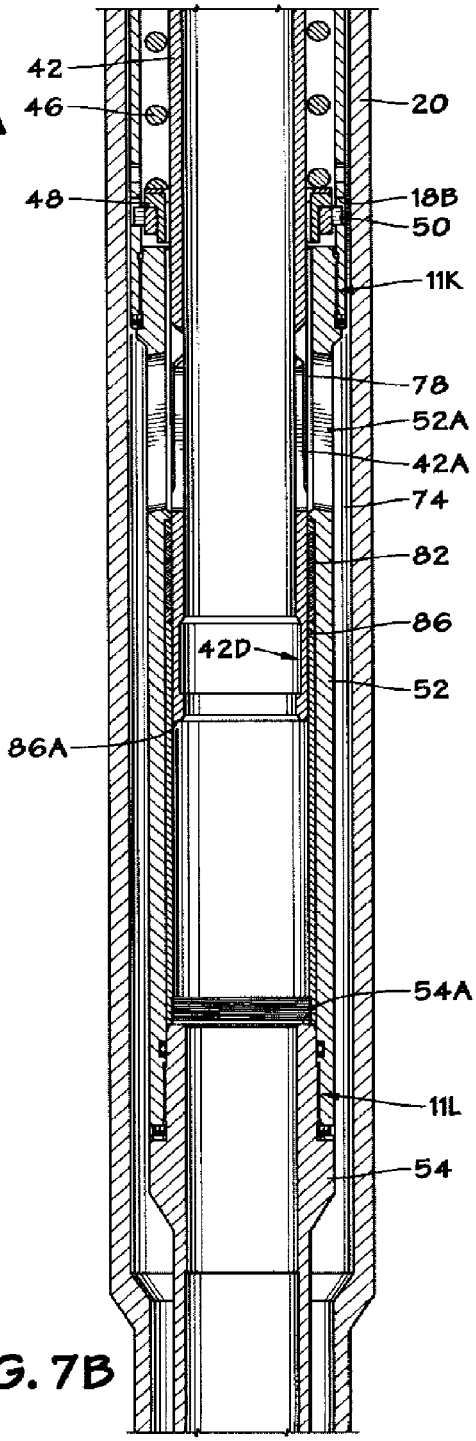

The operation of the tool 200 is similar in many respects to the operation of the tool 100. As shown in FIGS. 5A-5D, the tool 200 is in its "run-in" position. The flow openings 52A are blocked by the closing sleeve 42. In FIGS. 6A-6B, the pressure within the tubing is increased to shear the shear connection 13A to thereby release the first piston 36 and permit it to travel to its uppermost position. Thereafter, as shown in FIGS. 7A-7B, the pressure in the tubing is reduced to below the lower zone pressure, thereby causing the second piston 40 to travel to its uppermost position. Upward movement of the second piston 40 also causes upward movement of the closing sleeve 42 since it is coupled to the piston 40 by shear pin connection 13B. Movement of the closing sleeve 42 to this uppermost position aligns the openings 42A in the closing sleeve 42 with the openings 52A in the ported sub 52 to thereby permit fluid flow through the valve. The snap ring 75A engages the profile 40X in the second piston 40.

Unlike the tool 100, the tool 200 is reclosable by virtue of the use of the upper and lower seal stacks 80, 82 instead of simple O-ring type seals. As discussed above, the valve is initially opened using the sequence described above. The closing sleeve 42 in the tool 200 comprises profiles 42C, 42D that may be engaged by a wireline tool (not shown) to mechanically move the closing sleeve 42 to either a closed or open position. The mechanical movement of the closing sleeve 42 may be performed as many times as needed during production operations.

The radial flow valve described herein comprises a plurality of flow openings, a first piston and a second piston, wherein the first and second pistons are independently actuable relative to one another. The valve also comprises a sleeve that is operatively coupled to the second piston, the sleeve is adapted to be positioned so as to block or not block the plurality of flow openings. The first piston is releasably coupled to a component of the valve, such as an upper piston housing. The first piston may be releasably coupled to the valve component by a variety of known techniques, such as by a plurality of shear pins. The first piston is movable when a pressure within the valve is greater than an upper zone pressure with a well, while the second piston is movable when the pressure within the valve is approximately equal to or less than a lower zone pressure within the well. The second piston is secured in its initial position until the first piston is moved from its initial position. The sleeve has at least one profile formed in an interior surface of the sleeve that is adapted to be engaged by a wireline tool. The sleeve may be operatively coupled to the second piston by any of a variety of known techniques, such as by means of a plurality of shear pins. The valve also comprises a spring positioned proximate the second piston, the spring being adapted to apply a biasing spring force to the second piston so as to urge the second piston to move toward its final position. The valve also includes a plurality of actuatable members, such as spring actuated dogs, that engage the first and second pistons when the first and second positions are in their initial positions and thereby secure the second piston in its initial position.

A method of using the valve comprises positioning the valve in a subterranean well bore having an upper zone pressure and a lower zone pressure, increasing a pressure within the valve to a value above the upper zone pressure to release the first piston within the valve, and after releasing the first piston, reducing the pressure within the valve to a value that is approximately the same as or less than the lower zone pressure to thereby permit the second piston within the valve to move and thereby permit fluid flow through the valve. The movement of the second piston also moves the sleeve so that the flow openings in the valve are no longer covered by the sleeve. Increasing a pressure within the valve to a value above the upper zone pressure shears an illustrative shear pin connection between the first piston and a component of the valve. In a further embodiment, e.g., when the valve is stuck or otherwise inoperable, the method includes inserting a wireline tool to engage a profile formed in an interior surface of the sleeve, applying a mechanical force to the sleeve to disengage the sleeve from the second piston and moving the disengaged sleeve to a first position where a plurality of openings in the sleeve are substantially aligned with the plurality of flow openings in the valve, thereby permitting fluid flow through the valve. The method may also include moving the disengaged sleeve from the first position to a second position wherein the sleeve blocks the flow openings in the valve.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method, comprising:

positioning a radial flow valve in a subterranean well bore having an upper zone pressure and a lower zone pressure;

increasing a pressure within the valve to a pressure above the upper zone pressure to release a first piston within the valve; and after releasing the first piston, reducing the pressure within the valve to a value that is approximately equal to or less than the lower zone pressure to thereby permit a second piston within the valve to move and thereby permit fluid flow through the valve;

wherein a difference between the upper zone pressure and lower zone pressure is different from a difference in pressure that would exist from hydrostatic pressure alone; and wherein said second piston is secured in its initial position until said first piston is moved from its initial position in a direction away from said second piston.

2. The method of claim 1, wherein said second piston moves toward said first piston and thereby moves a sleeve that is releasably coupled to said second piston, wherein movement of said sleeve toward said first piston uncovers a plurality of flow openings in the valve.

3. The method of claim 2, wherein said second piston is releasably coupled to said sleeve such that said sleeve is moved in an uphole direction when said second piston moves in the uphole direction.

4. The method of claim 2, wherein said sleeve has a plurality of openings that are adapted to be substantially aligned with the flow openings in the valve to thereby permit fluid flow therethrough.

5. The method of claim 2, wherein said sleeve has at least one profile formed in an interior surface of the sleeve that is adapted to be engaged by a wireline tool.

6. The method of claim 2, wherein said first and second pistons are independently actuable relative to one another.

7. The method of claim 1, wherein increasing a pressure within the valve to a value above the upper zone pressure to release the first piston within the valve shears a shear pin connection between the first piston and a component of the valve.

8. A method, comprising:

positioning a radial flow valve in a subterranean well bore having an upper formation pressure and a lower formation pressure;

increasing a pressure within the valve to a pressure above the upper formation pressure to release a first piston within the valve; and after releasing the first piston, reducing the pressure within the valve to a value that is approximately equal to or less than the lower formation pressure to thereby permit a second piston within the valve to move and thereby permit fluid flow through the valve;

wherein a difference between the upper formation pressure and lower formation pressure is different from a difference in pressure that would exist from hydrostatic pressure alone; and wherein said second piston is secured in its initial position until said first piston moves from its initial position relative to said second piston.

9. The method of claim 8, wherein said first piston moves in a direction away from said second piston.

10. The method of claim 8, wherein said second piston moves toward said first piston and thereby moves a sleeve that is releasably coupled to said second piston, wherein movement of said sleeve toward said first piston uncovers a plurality of flow openings in the valve.

11. The method of claim 10, wherein said second piston is releasably coupled to said sleeve such that said sleeve is moved in an uphole direction when said second piston moves in the uphole direction.

12. The method of claim 10, wherein said sleeve has a plurality of openings that are adapted to be substantially aligned with the flow openings in the valve to thereby permit fluid flow therethrough.

13. The method of claim 10, wherein said sleeve has at least one profile formed in an interior surface of the sleeve that is adapted to be engaged by a wireline tool.

14. The method of claim 10, wherein said first and second pistons are independently actuable relative to one another.

15. The method of claim 8, wherein increasing a pressure within the valve to a value above the upper formation pressure to release the first piston shears a shear pin connection between the first piston and a component of the valve.

* * * * *